US005987858A

United States Patent [19]

Long

[11] Patent Number: 5,987,858

[45] **Date of Patent: *Nov. 23, 1999**

[54] APPARATUS FOR DENSIFYING AND PACKAGING A BULKY MATERIAL

[75] Inventor: James Michael Long, Toledo, Ohio

[73] Assignee: Johns Manville International, Inc.

[ * ] Notice: This patent is subject to a terminal disclaimer.

[21] Appl. No.: 08/519,375

[22] Filed: Aug. 25, 1995

Related U.S. Application Data

[62] Division of application No. 08/227,432, Apr. 14, 1994, Pat. No. 5,459,982.

[51] Int. Cl.[6] ..... B65B 1/24

[52] U.S. Cl. ..... 53/529; 53/525; 53/527; 53/530; 16/355; 16/356; 100/190; 100/233

[58] Field of Search ..... 53/523, 529, 527, 53/530, 438, 439, 436; 16/268, 355, 356; 100/233, 190

[56] References Cited

U.S. PATENT DOCUMENTS

| | | | |
|---|---|---|---|
| 3,088,499 | 5/1963 | Rieger | 53/258 |
| 3,621,775 | 11/1971 | Dedio et al. | 53/530 |
| 3,694,992 | 10/1972 | Hunt | 53/438 |
| 4,162,603 | 7/1979 | Stromberg | 53/529 |
| 4,406,379 | 9/1983 | Anderson et al. | 16/356 |
| 5,459,982 | 10/1995 | Long | 53/529 |

*Primary Examiner*—Eugene L. Kim
*Attorney, Agent, or Firm*—Robert D. Touslee

[57] ABSTRACT

A movable retaining wall is used in a first position in a compression baler to retain a compressed mass, such as microfibers, and is then moved to a second position into an opening in a wall of a packaging chamber filling the opening such that a gap between the edges of the interior surface of the retaining wall and the edges of the opening is too small to allow the compressed material to enter the gap when it passes through the packaging chamber and past the gap. To accomplish this requires the use of hidden hinges to guide the retaining wall as it moves from the first position to the second position and back to the first position. The hidden hinges allow the retaining wall to move essentially straight out of the opening in the wall of the packaging chamber before it begins to pivot towards the second position, thus allowing the tight fit. This feature prevents damage to the material being packaged since if it enters a gap while compressed, agglomerates will be formed when the compressed mass is moved through the apparatus which agglomerates cause processing problems and product defects.

10 Claims, 8 Drawing Sheets

APPARATUS FOR DENSIFYING AND PACKAGING A BULKY MATERIAL

This application is a division of application Ser. No. 08/227,432, filed Apr. 14, 1994 now U.S. Pat. No. 5,459, 982.

BACKGROUND

Bulky materials are costly to ship per unit weight because of their low density. Many bulky materials are capable of being compressed to substantially densify the material prior to packaging and this is common practice to make handling, storing and shipping easier and more economical. Fine fibers made from glass or polymers are bulky and it is common practice to mechanically compress them to a fraction of their initial volume and then restrain the compressed mass in a container such as a plastic or paper bag for shipment.

Equipment for doing this is available, but this equipment tends to damage the material, such as fine fibers, which detracts from the performance of the material and introduces agglomerate defects into the material. These agglomerates frequently cause defects in the final products containing the bulky material.

BRIEF DESCRIPTION OF THE INVENTION

This invention involves an apparatus for densifying and packaging bulky materials and more particularly an apparatus that performs these functions without damaging the material. This is accomplished by a unique design which eliminates contacting hinges, significant gaps and rough surfaces that catch and damage material causing the material to break down and smear and/or roll into pils or agglomerates.

The present invention is an improved compressing and packaging machine for bulky material, such as glass microfibers having mean fiber diameters from 0.1 to at least 5 microns and having densities as low as 0.1 PCF or less requiring the machine to cycle through as many charges as necessary to form each package of desired weight of compressed mass.

This improved compressing and packaging machine has a hopper with one pivoting wall, a compression chamber, a compressing cylinder and platen, a packaging chamber, a movable restraining wall, and a pusher platen and cylinder. The improvement comprises a compression chamber long enough that the hinge for the pivoting hopper wall is located along the compression chamber beyond where the compressed material will expand to when the compression platen is withdrawn to start another charge. Another optional improvement is a unique hinge that allows lowly compressed material to slide over it without damaging the material.

Another optional improvement comprises a retaining wall that, when moved, moves away from the highly compressed mass instead of sliding past the compressed mass and to a position where the restraining surface then becomes a portion of one interior surface of the packaging chamber with the interior surfaces perfectly or essentially aligned creating no damage to compressed material sliding thereon.

A further improvement comprises a design that insures that any gaps or slots that the compressed material slides past will be of such small dimension in the direction the material is sliding that the compressed material does not significantly expand into said gaps or slots.

A still further optional improvement comprises lining all surfaces on which compressed material will slide or contact with a low friction, wear resistant plastic material, such as high density polyethylene.

Other preferred features are a chrome plated interior on the radius wall of the hopper opposite the pivoting wall and a plastic lining on the working faces of the pivoting wall and the restraining wall that extend beyond metal backer plates to which the plastic is attached, and finally, a design that locates all hydraulic or air cylinders and connections such that oil leaking from these items does not drip or run into the material being worked on.

BRIEF DESCRIPTION OF THE DRAWINGS

FIGS. 1–5 are vertical cross sections of a typical prior art device that show how the device works and why it damages the material it is working on.

DETAILED DESCRIPTION OF THE PRIOR ART

Figure 1:
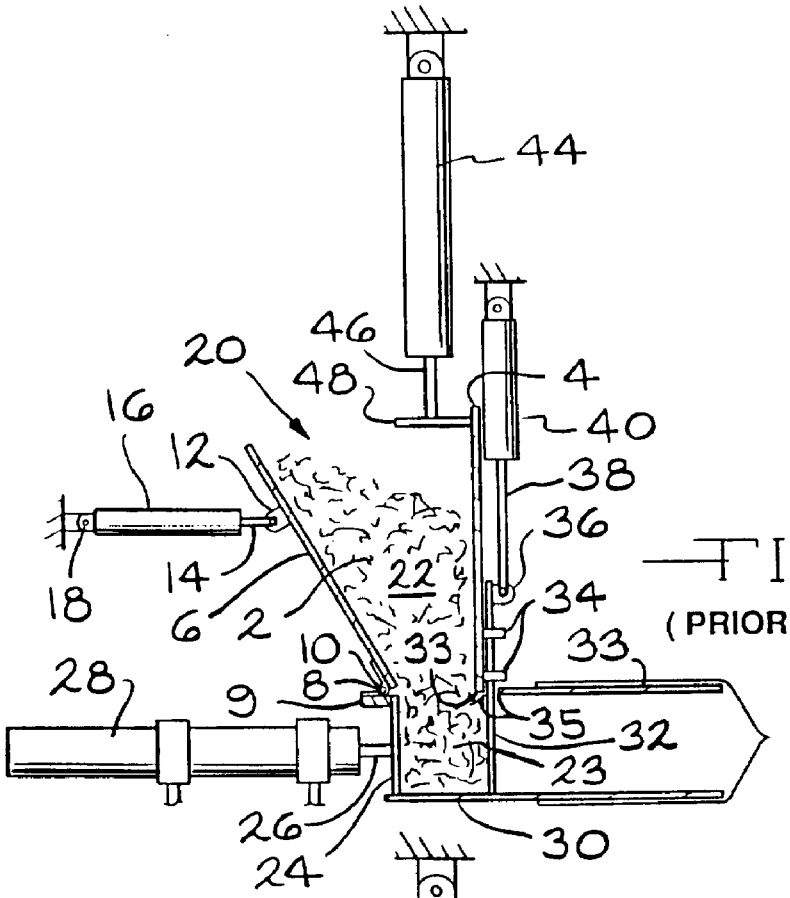
FIG. 1 (PRIOR ART)

FIG. 1 is a vertical cross section of the pertinent features of a popular bulky material densifying and packaging apparatus. The machine is composed of a materials hopper 2 defined by a backwall 4, a hinged front wall 6 and two endwalls (not shown). The front wall 6 is hinged at one end with piano hinge 8 which is attached to the front wall along the latter's lower edge and to a frame support member 9. A rod 10 joins the two pieces of hinge 8 together. A bracket 12 is attached to the outside face of the front wall and to this is pivotly mounted, with a pin, a clevis and rod end 14 of an air or hydraulic cylinder 16. Cylinder 16 is also pivotly mounted, such as by a clevis bracket on the cylinder end and a pin 18 through the bracket and a rigid frame member (not shown).

A bulky material 20, like glass microfibers having a mean fiber diameter of about 0.65 microns, is directed into the hopper 2 and builds up into a bulky mass 22 extending into a lower chamber 23. The lower chamber 23 is immediately below hopper 2 and is defined by an upstream vertical platen wall 24, a bottom wall 30, two endwalls (not shown), but extensions of the endwalls of the hopper 2, a downstream wall 32 and a horizontal top wall 33 located below and attached to the lower edge of backwall 4. The platen wall 24 is positioned immediately below piano hinge 8 and is movable horizontally within the lower chamber 23 by means of a hydraulic cylinder rod 26 attached to its backside and cylinder 28 which is rigidly attached to a frame (not shown). The downstream wall 32 extends through a slot 35 in top wall 33 and up through brackets 34 which are attached to the backside of backwall 4. Downstream wall 32 is movable vertically with cylinder 40 and rod 38 attached to a plate 36 fastened to the top backside of wall 32. The bottom side of wall 32 (see FIG. 2) fills most of slot 35, and is supposed to be part of top wall 33, when wall 33 is raised.

When the top level of mass 22 nears the top of the hopper 2, the flow of the material 20 into the hopper is stopped and cylinder 16 is activated to move the front wall 6 into a vertical position, compressing mass 22 to some extent. Next, a hydraulic cylinder 44, mounted vertically above hopper 2, is activated extending its rod 46 and an upper horizontal platen 48 rigidly attached to the end of rod 46 downwardly inside hopper 2 and compressing mass 22 into a compressed mass 27 (see FIG. 2).

Figure 2:
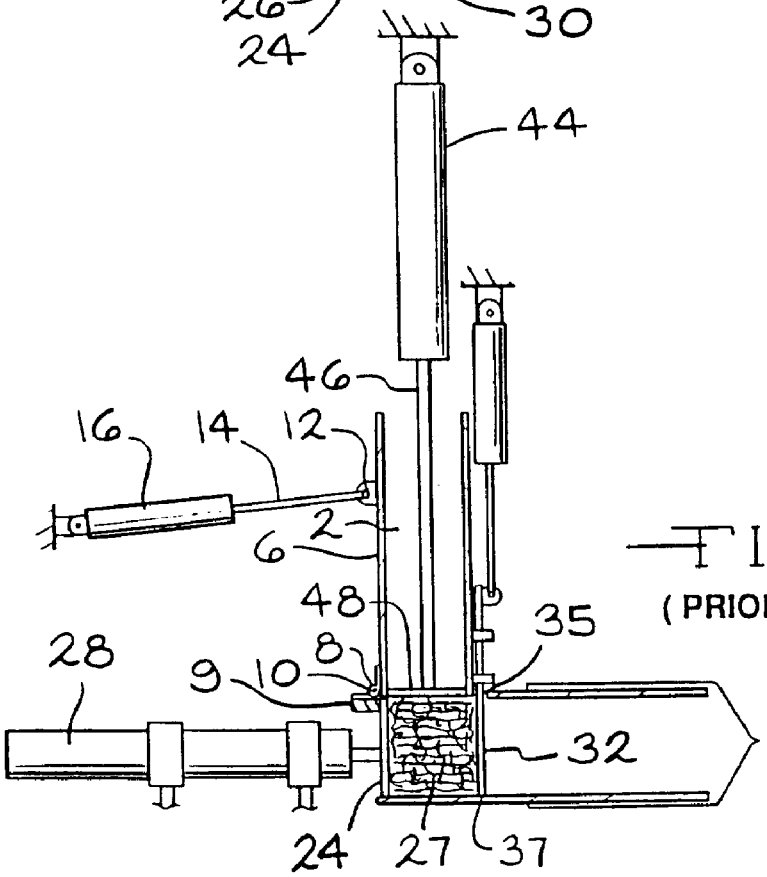
FIG. 2 (PRIOR ART)

When platen 48 reaches the top of lower chamber 23, as shown in FIG. 2, the mass 22 has been compressed to less than 25% of its previous volume and at that point cylinder 44 is reversed and rod 46 and platen 48 is withdrawn to the position shown in FIG. 1. During or immediately afterward, front wall 6 is retracted by rod 14 and cylinder 16 to the position shown in FIG. 1 and the flow of material 20 is restarted into hopper 2, as shown in FIG. 3.

Figure 3:
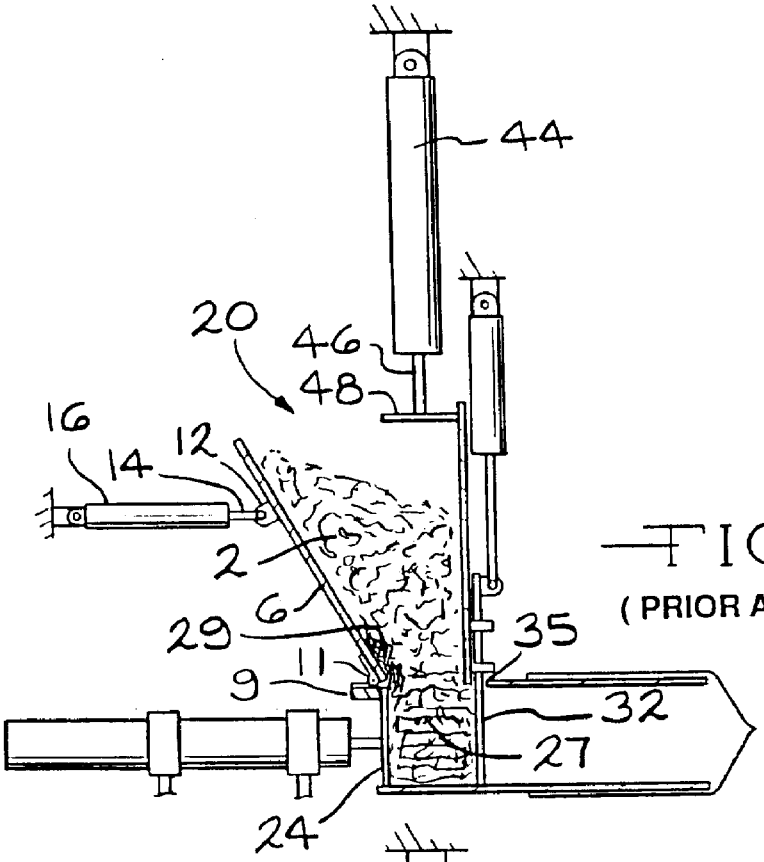
FIG.3 (PRIOR ART)

FIG. 3 also shows how the compressed mass 27, when the upper platen 48 is withdrawn, expands upwardly into hopper 2, sliding over hinge 8 and past a small gap 11 between the top of the platen wall 24 and the bottom edge of hopper wall 6, adjacent hinge 8. When a compressed bulky material is exposed to a gap, even a small gap of more than about one-sixteenth of an inch, it expands into the gap some distance. As the compressed material is being compressed downwardly and later expands upwardly, this combination of movement causes a shearing and rolling of the material that has expanded into any gap, and also around any protruding surface, forming dense agglomerates 29 along the affected outer surface of the compressed mass 27. These dense agglomerates are made up of damaged material, such as fibers, that are compressed and tangled to a much greater extent than the remainder of the mass. These dense agglomerates are harder to disperse later in air or liquid than the remainder of the mass and accordingly they frequently cause defects in the finished products that the compressed material is used to make.

Figure 4:
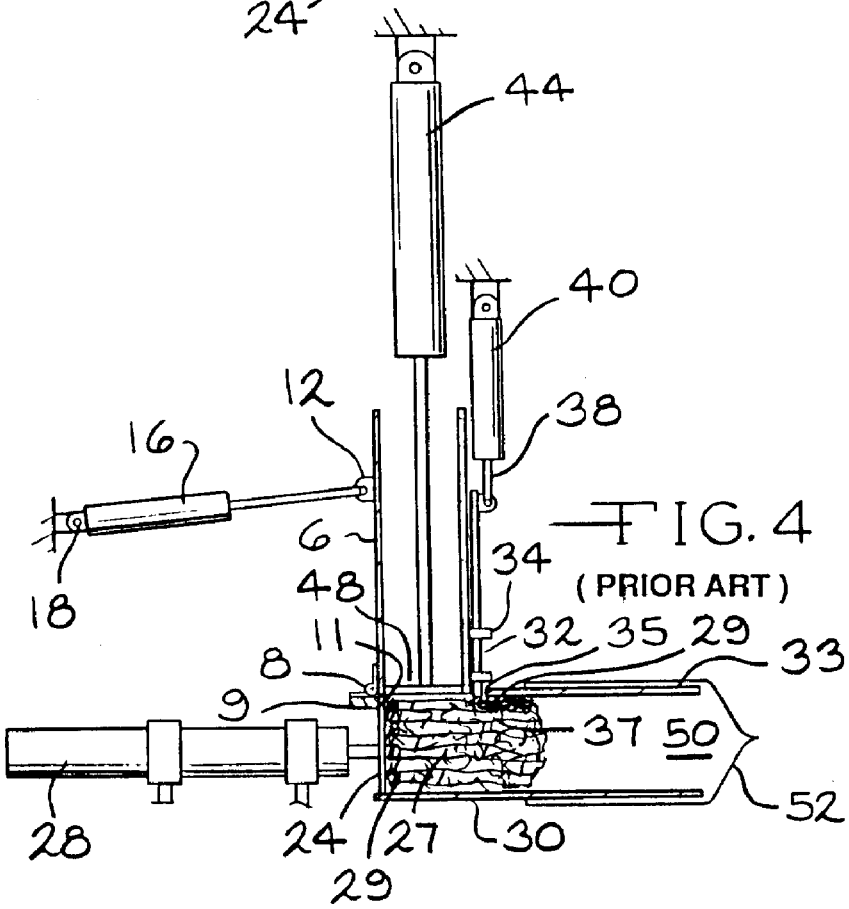
FIG. 4 (PRIOR ART)

The steps shown in FIGS. 1–3 are repeated several times until the compressed mass 27 reaches the desired density under compression by platen 48. At this point, as shown in FIG. 4, the downstream wall 32 is raised by energizing cylinder 40, withdrawing rod 38 and raising wall 32 through gap 35 as it slides through brackets and guides 34. As wall 32 moves upward it tends to pull compressed material up into and through one of the gaps 35 causing wear of the gap and agglomerates, some of which end up in the package of compressed mass. Sensors and switching gear (not shown) stop wall 32 when its lower edge or surface 37 is approximately even with the lower surface of upper wall 33, however due to variations in the sensing and hydraulic equipment, the lower surface 37 usually ends up just above or just below the lower surface of upper wall 33, which along with gaps between the surface 37 and the outer edges of slot or depression 35, create more gaps and sometimes another protrusion or depression that further damages the compressed mass when it is pushed through a chamber 38.

Figure 5:
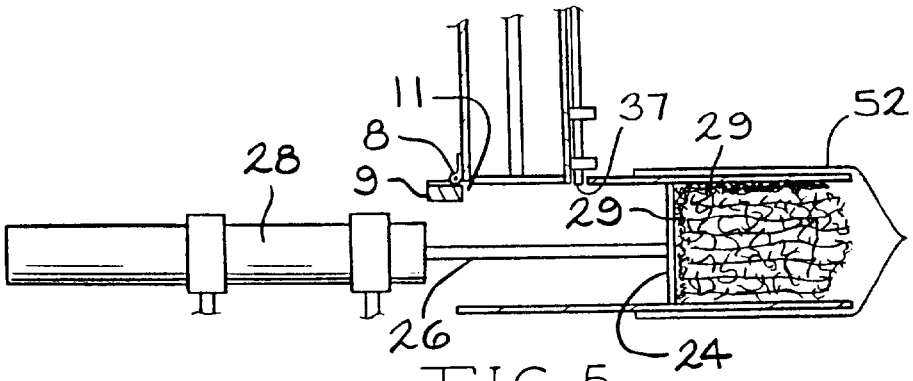
FIG. 5 ( PRIOR ART )

As shown in FIG. 4, when the downstream wall 32 is raised the compressed mass 27 expands into the adjacent packaging chamber 50. As the mass 27 expands, its upper surface moves across the gaps, and at times the protrusion or depression of the surface 37, causing agglomerates 29 on the top surface of mass 27. The next step is to push compressed mass 27 through chamber 50 and into a plastic or paper bag or container 52 by energizing cylinder 28 to extend rod 26 and move platen wall 24 horizontally until it has moved the compressed mass 27 completely out of chamber 50 pulling bag 52 along with it. This movement, as shown in FIG. 5, creates more agglomerates 29 as the entire mass 27 moves across gaps 35 and protrusion 37.

Another disadvantage of this prior art device is the location of cylinders 40 and 44. Hydraulic cylinders and the accompanying fittings are notorious for leaking hydraulic fluid with use and vibration. With this machine design, leaking fluid from these two cylinders falls or runs along lower surfaces into the material being packaged contaminating it and leading to costly scrap and customer complaints.

DETAILED DESCRIPTION OF THE INVENTION

Figure 6:
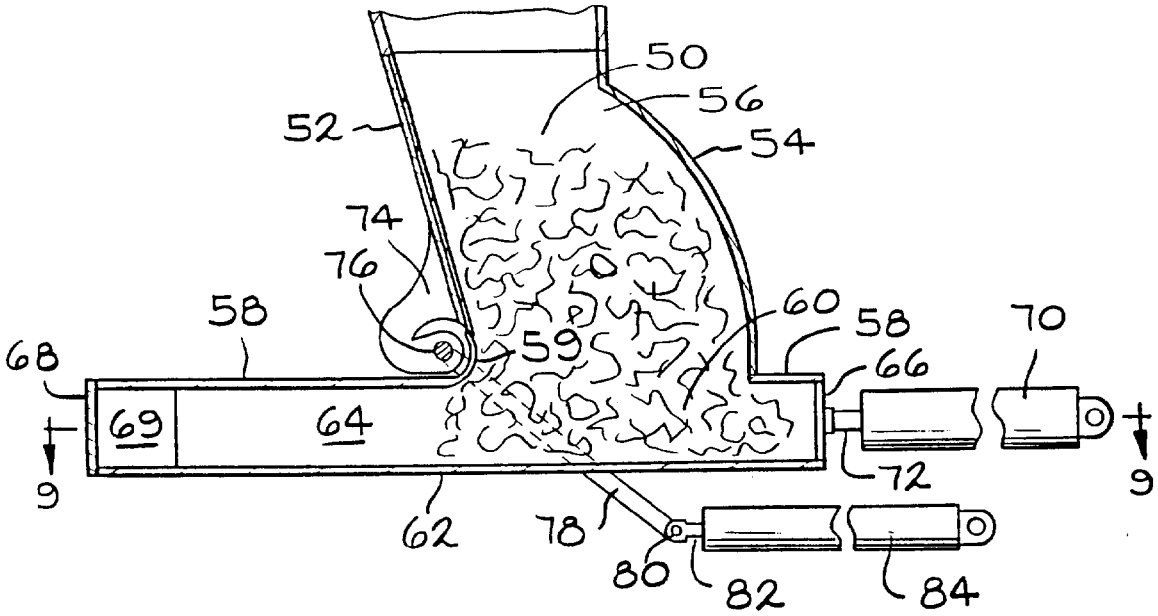
FIGS. 6 and 12–15 are vertical cross sections of the preferred embodiment of the present invention that show how the invention works and how the invention avoids the prior art elements that damage the material.

FIG. 6 is a vertical cross section of the preferred embodiment of the present invention. A hopper 50 is formed by a pivoting wall 52, a radius wall 54 opposite said pivoting wall 52, an extension 59 of a compression chamber top wall 58 and two sidewalls 56 opposite each other. Each of the sidewalls is attached to the radius wall 54 along one of its generally vertical edges with the opposite vertical edge extending at least to the back surface of the pivotal wall when the latter wall is in a retracted position as shown in FIG. 6. Preferably, the interior of the radius wall is chrome plated to insure against wear and contamination of the material being packaged. The hopper 50 is mounted to the top walls 58 of a compression chamber 60.

The compression chamber 60 is formed by the top walls 58, a bottom wall 62, two opposed sidewalls 64, a movable compressing platen wall 66, a movable pusher platen wall 69, a movable retaining wall 96 (see FIG. 10) and an end wall 68. The compressing platen wall 66 is designed to fit snugly inside the confines of the top, bottom and sidewalls and to be moved through the compression chamber 60 by activating a cylinder 70 to first extend and then withdraw a cylinder rod 72 which is attached to said platen wall. The interior surface of the platen wall 69 is perfectly aligned with the interior surface of the sidewall 64 by a means which will be defined later.

The pivoting wall 52 is supported by brackets 74 attached to the back side of said wall 52, which brackets are in turn rigidly attached and supported by a shaft 76. The shaft 76 is supported in a rotatable manner with shaft bearing mounts near each end (not shown) mounted on a frame (not shown) of the machine in a common manner of practice. A pivot arm 78 is rigidly attached to the shaft 76 at one end. The other end of the pivot arm 78 is attached, in a pivoting manner, to a clevis 80 attached to an end of a rod 82 of an air or hydraulic cylinder 84.

Figure 7:
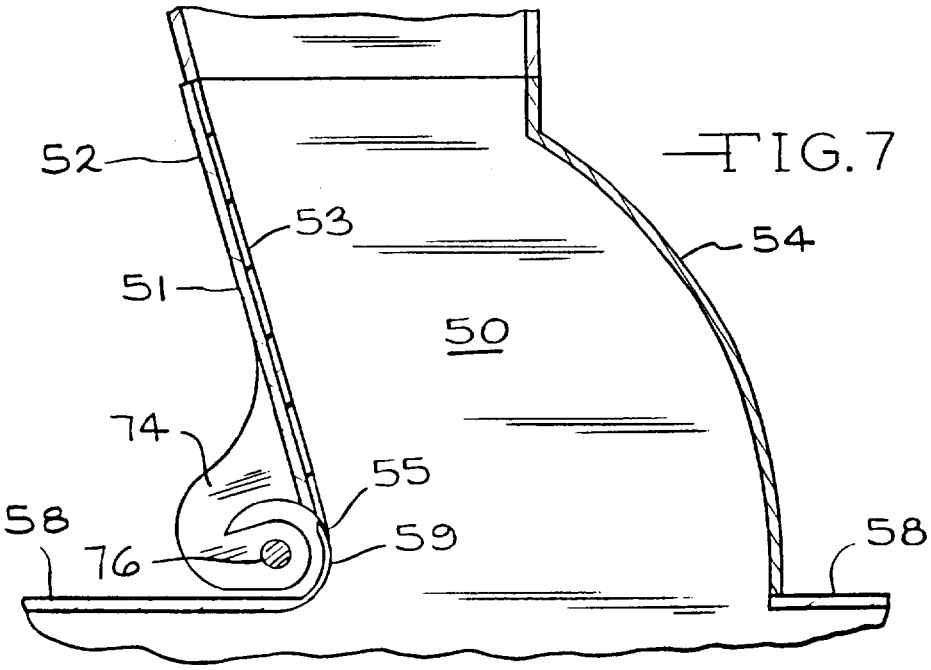
FIGS. 7 and 8 are partial vertical cross sections of the preferred embodiment and show details of a pivoting wall and a unique hinge.

FIG. 7 shows more detail of the pivoting wall 52 and its mount. A plastic lining 53, preferably of high density polyethylene, is attached to the inside surface of a backing plate 51 to form the pivoting wall 52. The lining 53 extends beyond the backing plate 51 on all sides to prevent any galling metal to metal contact as wall 52 is pivoted around shaft 76. The lower end 55 of lining 53 is tapered and is in close proximity or slight contact with an extension 59 of the top wall 58. The curvature of the extension 59 is the same radius that the tapered edge 55 makes as wall 52 is pivotly moved through hopper 50 so that edge 55 continues to wipe the hopper side of the extension 59 as the wall 52 moves through hopper 50. Preferably, a maximum of one sixteenth of an inch clearance is maintained between the edges of the lining 53 and the other walls of the hopper as the wall 52 moves through hopper 50.

Figure 8:
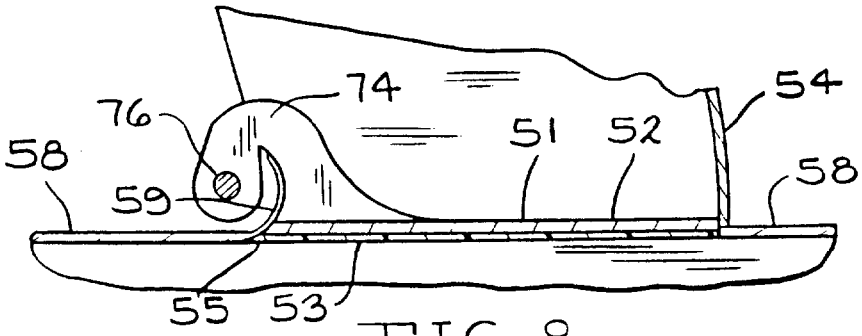

FIG. 8 shows the pivot wall 52 in its other extreme position as will be described later wherein the plastic lining 53 is aligned with the underneath surface of the top wall 58. The tapered edge 55 is in light contact or preferably no more than about a sixteenth of an inch from the lower portion of the extended surface 59, and the opposite edge of the lining 53 is in light contact or preferably no more than about one sixteenth of an inch from the interior surface of the lower portion of the radius wall 54.

Figure 9:
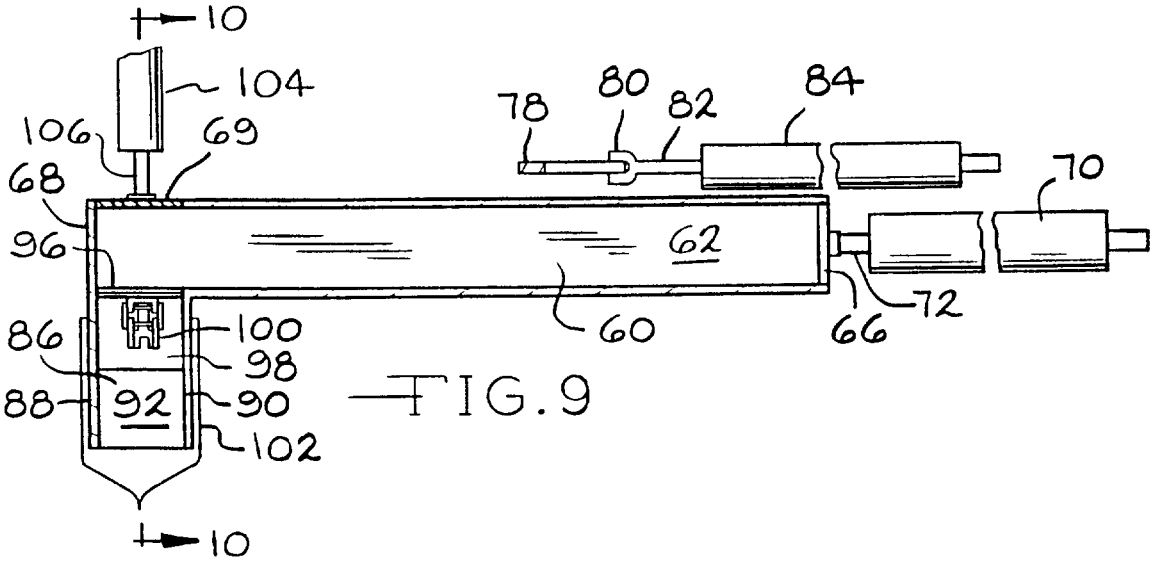
FIGS. 9 and 16 are horizontal cross sections of the preferred embodiment.

The remainder of the machine of the present invention is shown in FIG. 9, a horizontal or plan cross section taken along lines 9—9 of FIG. 6. overlapping compression a portion of compression chamber 60 and extending at a right angle beyond compression chamber 60 is a packaging chamber 86 defined by the endwall 68 which extends well beyond the compression chamber 60 at a right angle to form one sidewall 88, an opposite parallel sidewall 90 which attaches to the sidewall that is opposite the sidewall 64 adjacent the pusher platen 69, a bottom wall 92 having an opening therein and which is attached to the bottom wall 62 and extends from it in the same plane at a right angle, a top wall 94 (see FIG. 10) that is parallel to and opposite to bottom wall 92 and which is attached to the top wall 58 and extends from it at a right angle, the pusher platen wall 69 and a movable retainer wall 96 (when in a retracted position). The movable retainer wall 96 can be retracted to fill an opening 98 in the bottom wall 92, becoming a continuation of the bottom wall 92, by means of an assembly 100.

A package, usually a plastic or paper bag, 102 is slipped over the outer walls of the packaging chamber 86 to be filled with a charge of compressed product and pushed off of the chamber 86 by means of the pusher wall 69 moving through chamber 86 upon activation of hydraulic cylinder 104 thus extending cylinder rod 106. The hydraulic cylinder 104 is carefully positioned and retained in a position such that when the rod 106 is fully retracted to a dead head position, the interior surface of the platen wall 69 is perfectly aligned with the interior surface of the sidewall 64.

Figure 10:
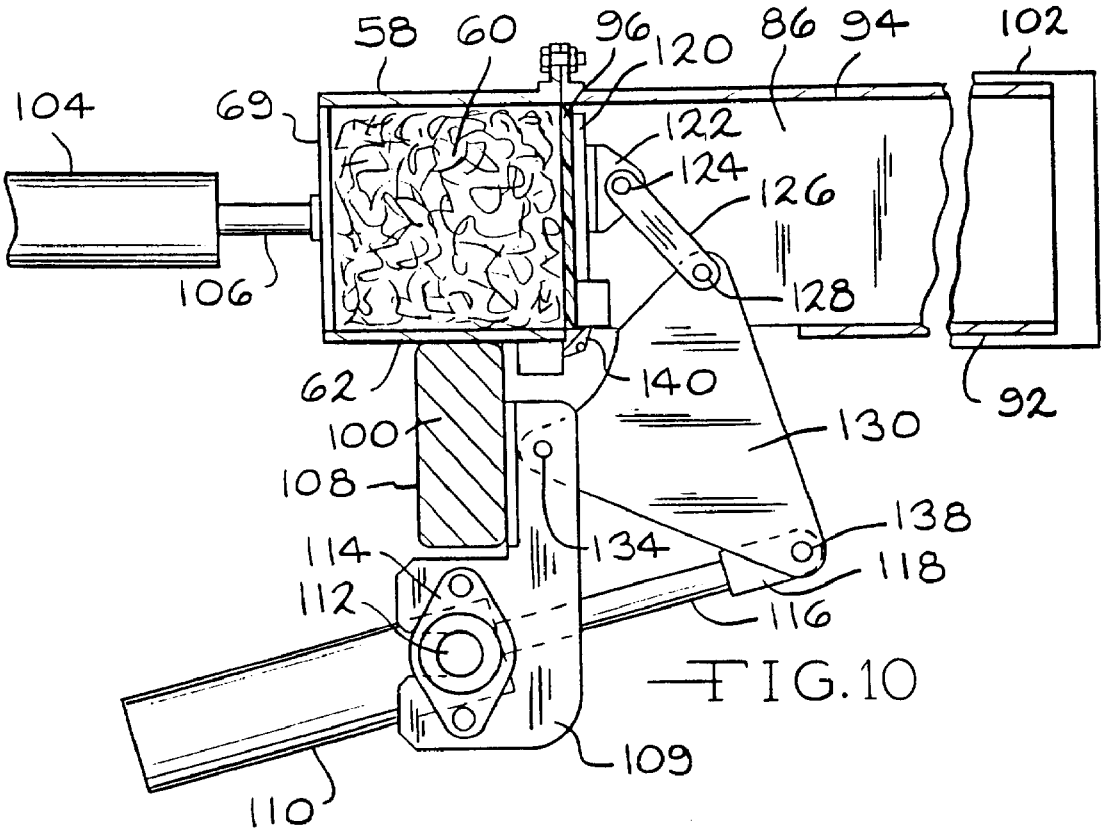
FIGS. 10 and 17 are partial vertical cross sections of the preferred embodiment and show details of a unique restraining door design which avoids the significant gaps and misalignments in the prior art devices that impede the smooth flow of the material being processed.

FIG. 10, a partial vertical cross sectional view taken along lines 10 in FIG. 9, shows the assembly 100, used to move the retainer wall 96, in detail. The assembly comprises a frame or support 108 located beneath the portion of the bottom wall 62 that is adjacent the retainer wall 96, a hydraulic cylinder 110 attached to said support 108 by means of shaft stubs 112 attached to the housing of said cylinder 110 mounted in bearing supports 114 attached to a bracket 109 which is attached to said support 108 such that the cylinder 110 can pivot around said stubs 112 as a cylinder rod 116 with a clevis 118 attached to its end is extended and retracted. The retainer wall 96 has a smaller backer plate 120 fixed to its backside with a shaft mount 122 attached to the backside of the backer plate 120. The vertical centerline of the backer plate 120 and that of the shaft mount 122 align with the vertical centerline of the retainer wall 96. The horizontal centerline of the backer plate 120 is parallel to but above the horizontal centerline of the retainer wall 96 and the horizontal centerline of the shaft mount 122 is parallel with but above the horizontal centerline of the backer plate 120. The backer plate extends to about one half inch of the top and side edges of the retainer wall 96, but ends several inches above the bottom edge of said wall to allow room for a special type of hinges to be attached to the lower portion of the retainer wall 96.

The shaft mount 122 is indirectly connected to the clevis 118 on the end of cylinder rod 116 by means of a series of connecting links and plates carefully designed to cause a shaft 124 in the shaft mount to move through a critical path defined by the special hinges attached to said retainer wall. This series of links and plates comprise at least one link 126 having a hole in each end portion to accommodate a shaft. The link or links 126 are attached at one end to the shaft 124 which is held by the shaft mount 122 and on the other end is attached to a shaft 128 which shaft also is attached to a pair of plates 130. One other end of the pair of plates 130 is attached to a shaft 134, which is also attached to brackets 109 at a location above the stub shaft mounts 114. The other corner of plates 130 are attached to a shaft 138 which is also attached to the clevis 118. Thus plates 130 triangular with the longest side spanning between connections with shafts 128 and 138.

The retaining wall 96 is sized such that no more than one sixteenth of an inch, and preferably no more than a clearance of about one thirty second of an inch, is maintained between each of its edges and the interior walls of the packaging chamber when the retaining wall is in a retaining position and between its edges and the edges of the opening 98 when the retaining wall is in its retracted position as an extension of bottom wall 92. The retaining wall 96 is mounted to the bottom wall 62 with a plurality of hinges 140 of a special type of hinge called a Soss hidden hinge available from Universal Industrial Products Company of Pioneer, Ohio. At least two and preferably three or more of these hinges are used to provide the strength needed to maintain the tight tolerances desired as described just above and to provide the type of movement desired as the retaining wall is retracted. The Soss hidden hinge permits the retaining wall, as it is retracted, to first move away from the compressed material and then down through the opening 98 to stop such that its surface is even with and parallel to the top surface of bottom wall 92.

Figure 11:
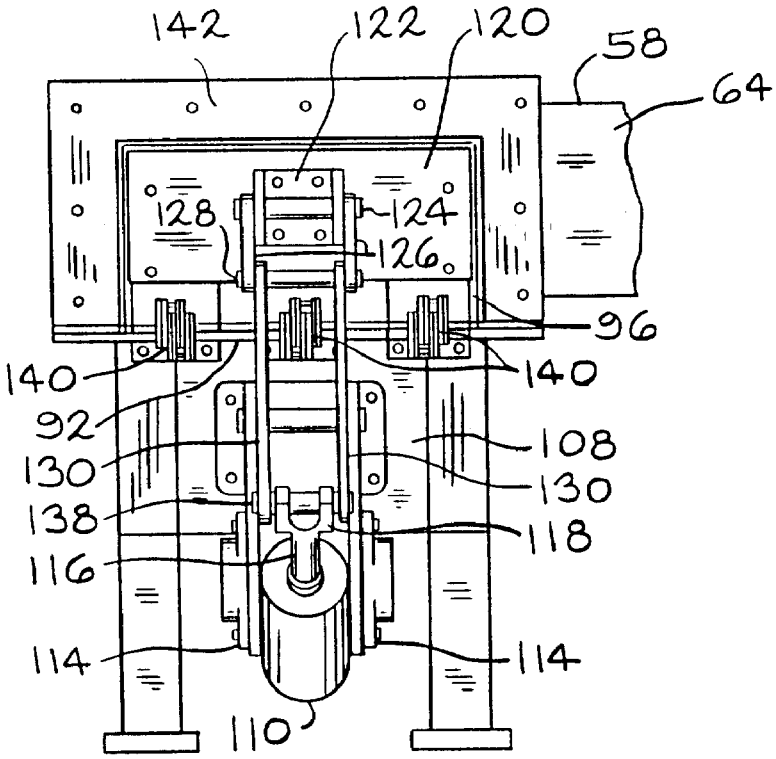
FIG. 11 is a partial side view of the partially assembled embodiment shown in FIGS. 10 and 17.

FIG. 11 is an end view of the packaging machine with the packaging chamber removed to show the backside of the retaining wall 96 and the retracting assembly 100. The packaging chamber section is bolted to the compression chamber section with flanges like flange 142. This view shows the positions of the three Soss hidden hinges 140 used in this embodiment.

Figure 12:
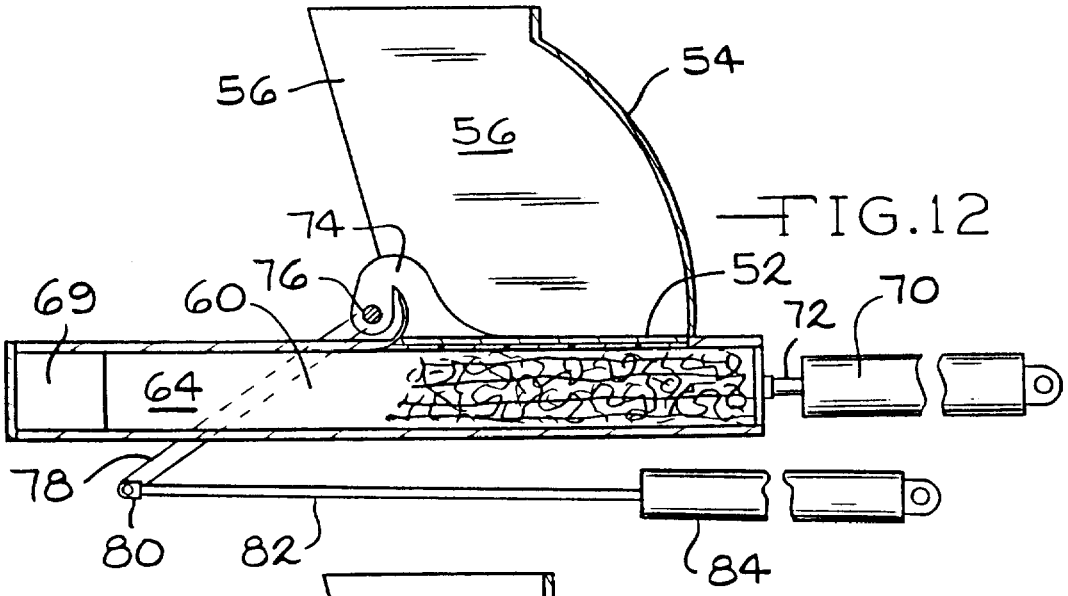

The packaging machine of the present invention is operated as follows. Referring to FIG. 6, the low density material to be packaged is fed into the hopper 50 from the top as shown by the arrow with the pivoting wall 52 in the open position. For purposes of this example the material being packaged is a glass microfiber product having a mean fiber diameter of about 0.6 microns and a loose fill bulk density of about 0.1 to 0.2 pounds per cubic foot, though the present invention is useful in packaging any low density solid or plastic material. When the hopper 50 is almost full the flow of material is interrupted and hydraulic cylinder 84 is energized to extend rod 82 thus pivoting the pivoting wall 52 through the hopper 50 compressing the material therein into the compression chamber 60 and ending in a horizontal position with its surface 53 aligned with the interior surface of the top wall 58 as shown in FIGS. 8 and 12 (a partial vertical cross sectional view).

Figure 13:
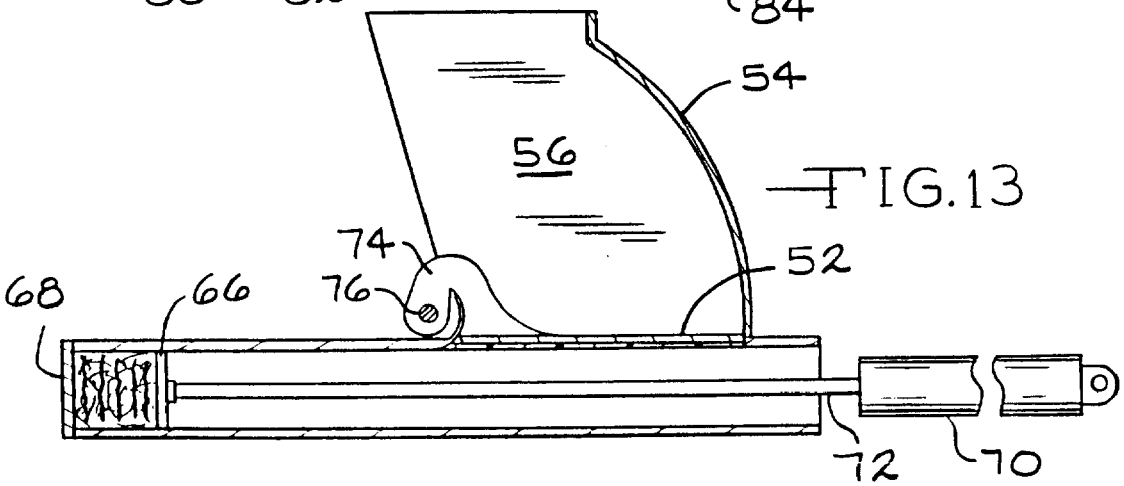

Referring next to FIG. 13, which is a partial vertical cross sectional view, hydraulic cylinder 70 is energized to extend rod 72 and to move the compressing platen wall 66 through the compression chamber towards end wall 68 thus compressing the material in chamber 60 and moving it to the downstream end of chamber 60.

Figure 14:
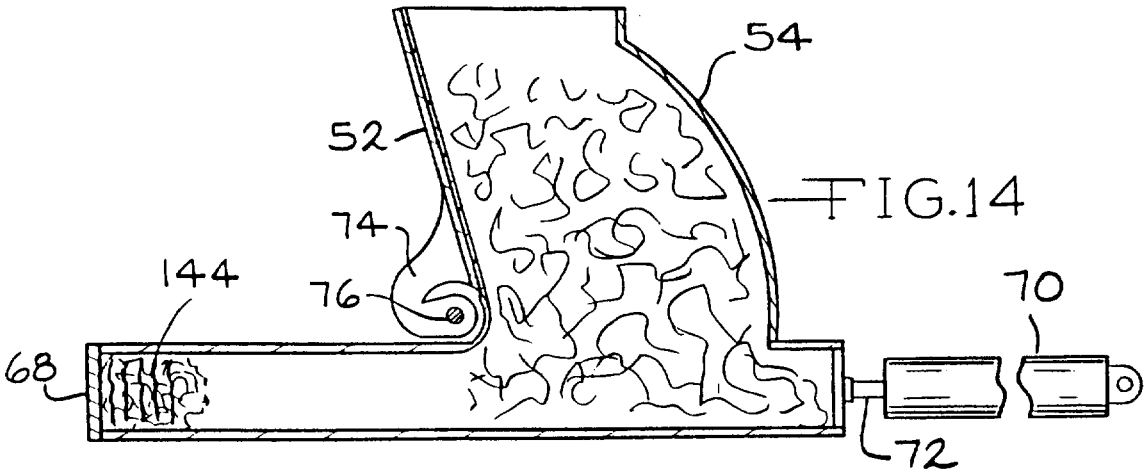

Hydraulic cylinders 70 and 84 are then reversed returning the machine to the position shown in FIG. 14, a partial vertical cross sectional view. The flow of material being packaged is once again directed into hopper 50 to begin another charge. When the compression platen 66 is returned to its start position the compressed material will expand along chamber 60 some as shown at 144 in FIG. 14.

Figure 15:
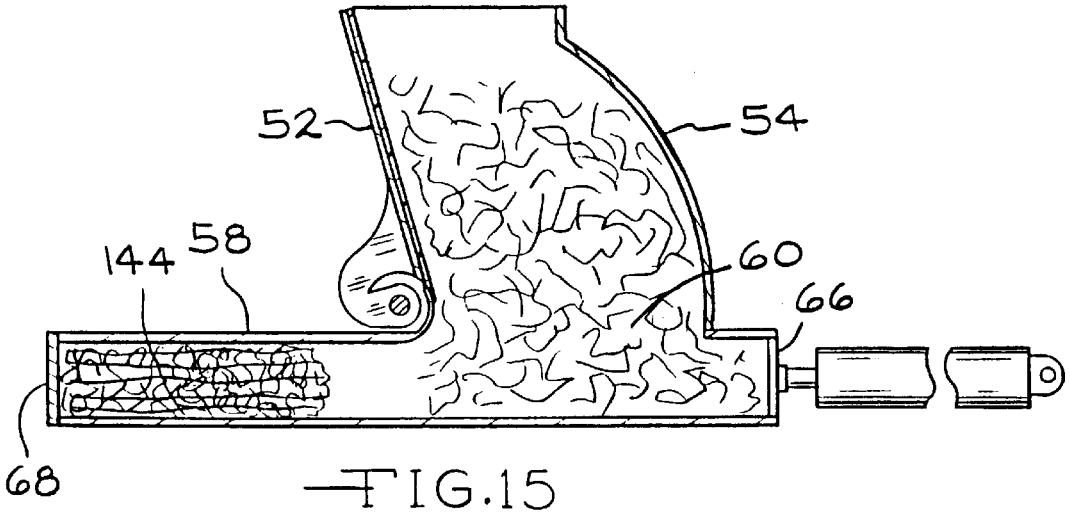

The charge cycle described in the above paragraphs is repeated as many times as necessary, typically 4–10 times, until the desired weight of material for a package is in the packaging machine. The machine of this invention is designed such that on the last charge cycle the relaxed compressed material 144 does not reach the bottom opening of hopper 50 or the extension 59, as is shown in FIG. 15, a partial vertical cross sectional view. This avoids forming agglomerates of material encountered in the prior art machine, in the machine shown in this embodiment, the distance between the interior face of the end wall 68 and the extension 59 is at least about two times the width of packaging chamber 86.

Figure 16:
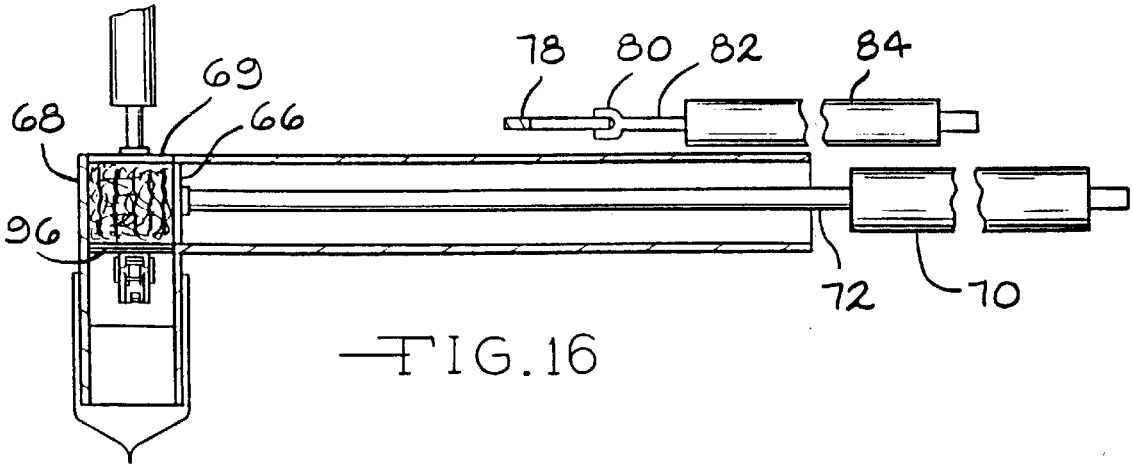
Figure 17:
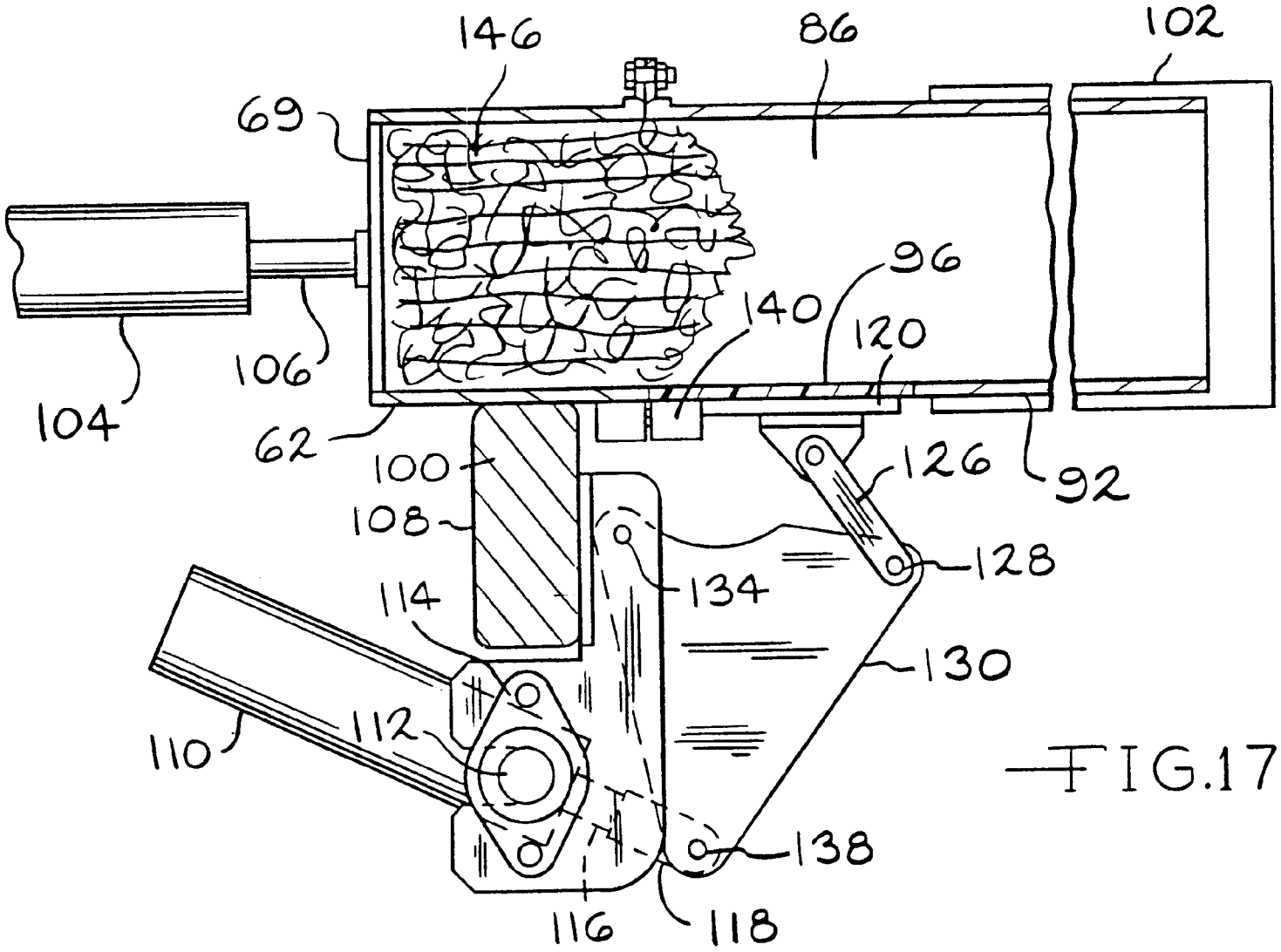

At the end of the last charging and compression cycle the machine is in the position shown in FIG. 16, a cross sectional plan view taken along lines 9—9 in FIG. 6. Next, referring to FIGS. 10 and 17, the retaining wall 96 is retracted by energizing the cylinder 110 and withdrawing the rod 116 until the interior face of the wall 96 is aligned with the interior face of the bottom wall 92 of the packaging chamber 86.

The machine of this invention is so designed that the gaps between the outer edges of the retaining wall 96 and the edges of the opening 98 that the retaining wall 96 fills in its fully retracted position is small. The gaps should normally be less than about one sixteenth of an inch, the maximum distance that fully compressed and partially relaxed material 146 will bridge without penetrating into this gap. By maintaining this small gap and avoiding the penetration of the material 146 into the gap, the agglomerated material encountered in the prior art machine is avoided as the compressed material is pushed through the packaging chamber 86.

Finally, the hydraulic cylinder 104 is energized extending the rod 106 and the pusher platen wall 69 through the packaging chamber 86 pushing the material 146 into the package 102 and pushing the material and the package out of and off of the packaging machine. It is important to complete this last step with the machine very quickly after the retaining wall 96 is retracted to minimize the expansion of the compressed material into the packaging chamber 86.

When the package is pushed off of the machine of the invention the open end of the package, which extend beyond the compressed material an appropriate amount, by gluing, sewing or heat sealing in a well known manner. A typical package will measure about 10 inches by 20 inches by 40 inches and will weigh about 51 pounds containing about 50 pounds of compressed material having a density of about 10.8 pounds per cubic foot.

Note that in the preferred embodiment disclosed above all the hydraulic cylinders are located remote from and below the material being packaged such that any leaks of oil from the cylinders or fittings do not drip or run into the material being packaged which is a problem with the prior art machines in use now.

I claim:

1. In an apparatus for compressing and packaging microfibers having a bulk density of less than about 0.2 PCF as produced, into a highly compressed mass, such as a bulk density of up to about 10.8 PCF or higher, surrounded at least partially with a restraining package and requiring at least two charging and compressing cycles comprising, a) a material hopper having a pivoting wall with means for pivoting said pivot wall, b) a compression chamber located adjacent to said hopper for receiving material from said hopper and means for compressing said material in said compression chamber to a highly compressed mass, c) a pivot for said pivot wall to permit said pivot wall to pivot, said pivot being located along said compression chamber and adjacent said one end of said hopper, d) a movable retaining wall forming at least part of one wall of said compression chamber and means for moving the retaining wall out of retainment, e) a packaging chamber and a pushing means to push the highly compressed mass out of the compression chamber and into and through the packaging chamber and into said restraining package, the improvement comprising, said movable retaining wall forming, when in a first position, at least an end portion of one wall of said compression chamber at the end where said highly compressed mass is formed, means for moving the retaining wall such that the surface in contact with the highly compressed mass moves away from said mass and then into an opening in a wall of said packaging chamber becoming a portion of one interior surface of said packaging chamber and is in smooth alignment with said interior surface of said packaging chamber when in a second position, said retaining wall moving means including a plurality of hidden hinges, said retaining wall interior surface forming tight joints with interior edges of the opening in said packaging chamber wall with a first gap between said retaining wall and the edges of said opening not exceeding a dimension that will allow the compressed material to significantly expand into said gap to form agglomerates of compressed material when the compressed material is pushed through said packaging chamber.

2. The apparatus of claim 1 wherein said dimension is less than one sixteenth of an inch.

3. The apparatus of claim 2 wherein said dimension is less than one thirty second of an inch.

4. The apparatus of claim 1 wherein said retaining wall interior surface form tight joints with interior edges of an opening in one of the walls of said compression chamber when in said first position with a second gap between said retaining wall and at least one edge of said wall of said compression chamber not exceeding a dimension that will allow the compressed material to significantly expand into said second gap to form agglomerates of compressed material when material is compressed into the end of said compression chamber.

5. The apparatus of claim 4 wherein said second gap dimension does not exceed about one sixteenth of an inch.

6. The apparatus of claim 5 wherein said second gap dimension does not exceed about one thirty second of an inch.

7. The apparatus of claim 4 wherein three hidden hinges are used to guide said retaining wall from said first position to said second position and to return to said first position.

8. The apparatus of claim 4 wherein said retaining wall moving means comprises a fluid actuated cylinder.

9. The apparatus of claim 8 wherein said retaining wall moving means further comprises a plurality of links between said fluid actuated cylinder and a backside of said retaining wall.

10. The apparatus of claim 9 wherein one of said links is pivotly mounted to a fixed frame located between said retaining wall and said cylinder, said links being out of contact with said hidden hinges.

* * * * *